United States Patent [19]

Kantner et al.

[11] Patent Number: 4,957,288

[45] Date of Patent: Sep. 18, 1990

[54] PUTTER POOL BILLIARD GAME

[76] Inventors: Hugh B. Kantner, Box 1931, Klamath Falls, Oreg. 97601; George Spector, 233 Broadway, Rm. 3815, New York, N.Y. 10007

[21] Appl. No.: 250,229

[22] Filed: Sep. 28, 1988

[51] Int. Cl.[5] ..... A63D 15/00

[52] U.S. Cl. ..... 273/2; 273/176 F

[58] Field of Search ..... 273/3 A, 2, 3 R, 3 C, 273/12, 85 R, 87 B, 87 C, 176 F, 176 FB

[56] References Cited

U.S. PATENT DOCUMENTS

| | | | |
|---|---|---|---|
| 574,351 | 12/1896 | Conner | 273/123 R |
| 669,375 | 3/1901 | Tarbet | 273/123 R |
| 3,138,387 | 6/1964 | Michel et al. | 273/87 C |
| 3,578,321 | 4/1968 | Skully | 273/87 B |
| 3,584,872 | 6/1971 | Nielsen | 273/3 C |
| 3,715,123 | 2/1973 | Baum | 273/87 B |
| 3,802,707 | 4/1974 | Frost | 273/123 R |
| 3,976,294 | 8/1976 | Maldonado | 273/123 R |
| 4,147,345 | 4/1979 | McGovern | 273/12 |
| 4,160,550 | 7/1979 | Barrett | 273/176 F |
| 4,203,604 | 5/1980 | Grange | 273/176 FB |

FOREIGN PATENT DOCUMENTS

| | | | |
|---|---|---|---|
| 1603050 | 2/1971 | Fed. Rep. of Germany | 273/12 |
| 760795 | 12/1933 | France | 273/2 |
| 12399 | of 1906 | United Kingdom | 273/2 |

*Primary Examiner*—T. Brown

[57] ABSTRACT

A golf putting game is provided and consists of a rectangular framework for use on a flat surface and pockets disposed within the framework for capturing a golf ball during the play of the game. The sides of the framework has a bottom undercut to receive a felt floor mat when the apparatus is assembled. The framework sides are further provided with a plurality of pockets, each pocket having an inwardly inclined floor to positively retain a ball therein.

1 Claim, 1 Drawing Sheet

PUTTER POOL BILLIARD GAME

BACKGROUND OF THE INVENTION

The instant invention relates generally to games of skill and knowledge and more specifically it relates to a golf putting game.

Numerous games of skill and knowledge have been provided in prior art that are adapted to simulate a miniature golf course for golf putting practice. For example, U.S. Pat. Nos. 4,160,550; 4,203,604 and 4,646,046 all are illustrative of such prior art. While these units may be suitable for the particular purpose to which they address, they would not be as suitable for the purposes of the present invention as heretofore described.

SUMMARY OF THE INVENTION

A primary object of the present invention is to provide a golf putting game that will overcome the shortcomings of the prior art devices.

Another object is to provide a golf putting game which can be used indoors and outdoors to perfect a golfer's putting skill.

An additional object is to provide a golf putting game that can be assembled to simulate a pool game in which the golfer will stand within to practice the golf putting.

A further object is to provide a golf putting game that is simple and easy to use.

A still further object is to provide a golf putting game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
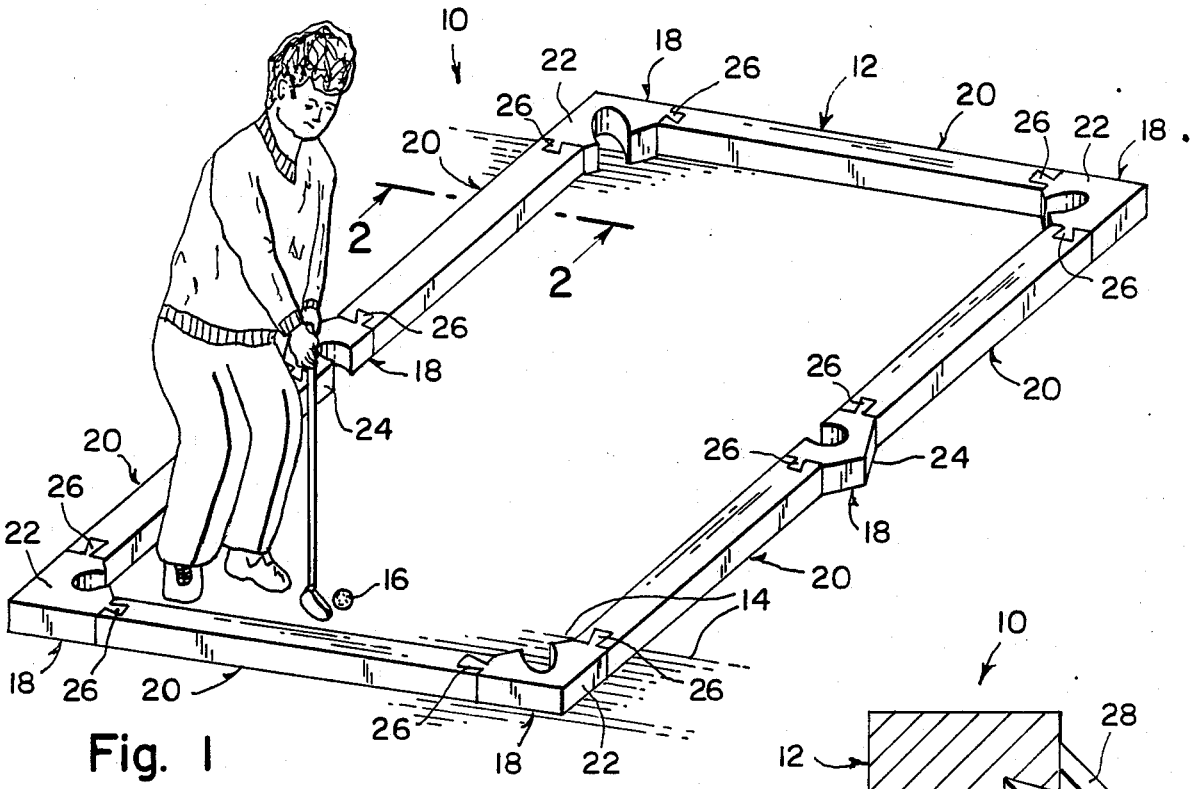
FIG. 1 is a perspective view of the invention.

Turning now descriptively to the drawings, in which similar reference characters denote similar elements throughout the several views, FIG. 1 illustrates a golf putting game 10 consisting of a framework 12 suitable for use on a flat surface 14, such as outdoor grass or an indoor floor. The framework 12 is in the shape of a rectangle to retain a played golf ball 16 within the bounds of the framework 12. Structures 18 are disposed within the framework 12 for capturing the golf ball 16 during the play of the game 10.

The framework 12 includes a plurality of barrier rail segments 20 while the structures 18 includes four corner pocket segments 22 and two side pocket segments 24. Each of the corner pocket segments 22 will interlock between two of the rail segments 20 at each corner of the framework 12 via a tongue and groove connectors 26. Each of the side pocket segments 24 will interlock between two of the rail segments 20 at each long side of the framework via the tongue and groove connectors 26.

Figure 2:
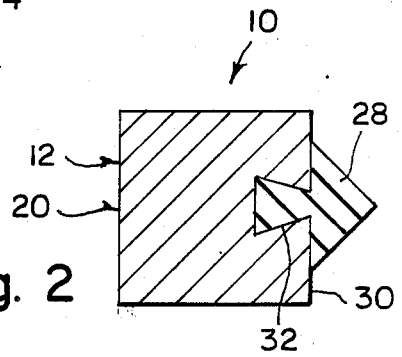
FIG. 2 is an enlarged cross sectional view taken along line 2—2 in FIG. 1, showing a flexible bumper disposed on the interior wall of the barrier rail segment.

The golf putting game 10 can include a plurality of flexible bumpers 28, one of which is shown in FIG. 2, being triangular in cross section and disposed on interior wall 30 of one of the rail segments 20 of the framework 12 via tongue and groove connector 32 to provide a uniform golf ball rebound during the play of the game 10.

Figure 3:
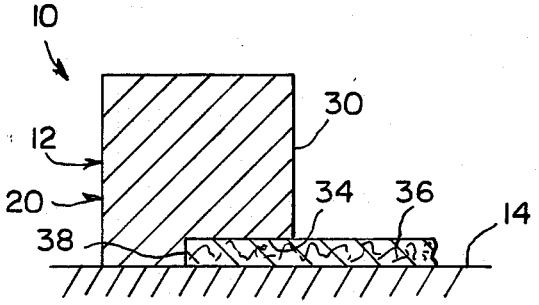
FIG. 3 is a cross sectional view similar to FIG. 2 of a modified barrier rail segment showing a felt floor mat.

As shown in FIG. 3, the rail segment 20 can have a bottom undercut 34 extending inwardly from the interior wall 30 thereof. A rectangular felt floor mat 36 can be provided, being of a size so that its edge 38 be held between the bottom undercut 34 and the flat surface 14 to simulate a pool table surface for the golf ball 16 to be played upon.

Figure 4:
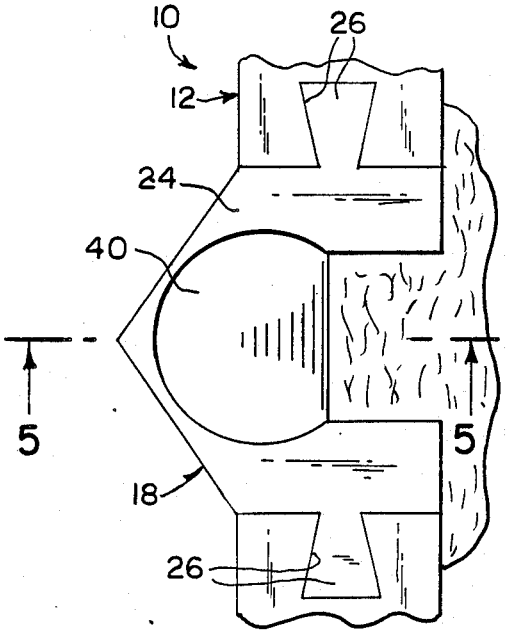
FIG. 4 is an enlarged top view of a modified side pocket segment having an enlarged inclined entrance area.
Figure 5:
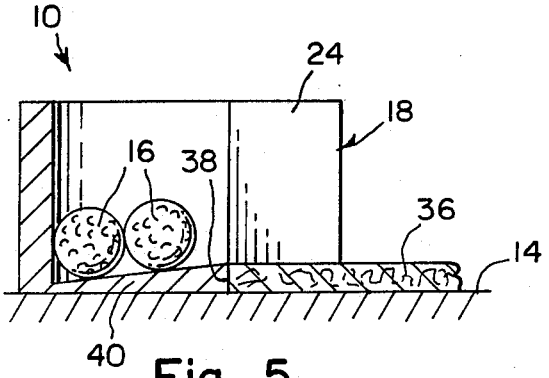
FIG. 5 is a cross sectional view taken along line 5—5 in FIG. 4, showing the inclined floor in greater detail.

As shown in FIGS. 4 and 5 the side pocket segment 24 can include an inwardly inclined floor 40 which butts up against the edge 38 of the felt floor mat 36 so that the golf ball 16 can be positively retained therein during the play of the game 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A golf putting game which comprises:

(a) a framework suitable for use on a flat support surface, in which said frame-work is in the shape of a rectangle to retain a played golf ball within the bounds of said framework;

(b) means disposed within said framework for capturing a golf ball during play of said game, wherein said framework includes a plurality of barrier rail segments comprising;

(c) four corner pockets, means interlocking, each of said corner pockets between two of said rail segments at each corner of said framework; and (d) a pair of side pockets, means interlocking each of said side pockets between two of said rail segments along each long side of said framework, a plurality of flexible bumpers, each of said bumpers being triangular in cross section and disposed on the interior wall of said rail segments of said framework to provide a uniform golf ball rebound during the play of said game;

(e) each of said rail segments having a bottom undercut extending inwardly from the interior wall thereof;

(f) a rectangular felt floor mat being of a size so that its edge can be held between said bottom undercut and the flat support surface to simulate a pool table surface for the golf ball to be played upon, each of said corner pockets and each of said side pockets includes an entrance opening of predetermined waste and an inwardly inclined floor which butts against the edge of said felt floor mat so that a golf ball can be positively retained therein during the play of said game, and wherein each said side pocket has a parallel side wall at said entrance opening and wherein said inwardly inclined floor has a circular portion of larger diameter than the width of said entrance opening.

* * * * *